United States Patent [19]

Baugh

[11] 3,933,108

[45] Jan. 20, 1976

[54] BUOYANT RISER SYSTEM

[75] Inventor: Benton F. Baugh, Houston, Tex.

[73] Assignee: Vetco Offshore Industries, Inc.

[22] Filed: Sept. 3, 1974

[21] Appl. No.: 502,280

[52] U.S. Cl. ..... 114/.5 D; 9/8 R; 175/7

[51] Int. Cl.[2] ..... B63B 35/00

[58] Field of Search ..... 9/8 R; 114/.5 D; 166/.5, 166/.6; 175/7, 8, 10; 61/46.5

[56] References Cited

UNITED STATES PATENTS

| | | | |
|---|---|---|---|
| 1,768,003 | 6/1930 | Roth | 9/8 R |
| 3,557,564 | 1/1971 | Hauber | 166/.5 |
| 3,605,413 | 9/1971 | Morgan | 114/.5 D |
| 3,605,668 | 9/1971 | Morgan | 114/.5 D |
| 3,621,910 | 11/1971 | Sanford et al. | 166/.5 |
| 3,643,751 | 2/1972 | Crickmer | 175/7 |

*Primary Examiner*—Trygve M. Blix
*Assistant Examiner*—Charles E. Frankfort
*Attorney, Agent, or Firm*—Pravel & Wilson

[57] ABSTRACT

A buoyant marine riser system adapted to extend from a floating platform to a subsea wellhead wherein one or more riser sections include a series of circumferentially spaced, elongated, hollow, closed buoyant tanks containing a gaseous medium to make such riser sections substantially buoyant.

5 Claims, 5 Drawing Figures

BUOYANT RISER SYSTEM

BACKGROUND OF THE INVENTION

The field of this invention is marine risers for offshore oil well drilling operations or the like.

In offshore oil well drilling operations, it is necessary to extend a casing from a floating drilling platform or vessel to the subsea wellhead. Such casing is generally known as a "marine riser". Marine riser systems generally consist of a series of hollow pipe sections which are connected both to the wellhead and to the floating platform. Examples of marine riser systems are found in U.S. Pat. Nos. 3,465,817 and 3,502,143.

Marine risers are subjected to severe environmental forces including the effects of wind, waves and current as well as hydrostatic pressure. In addition, the weight of a column of riser pipe sections of steel plus the weight of drilling fluid circulated through the riser sections tend to exert critical compression loading on a riser column. This compression column loading is generally compensated for by riser tensioners which are known in the art. However, several U.S. patents are generally directed to the use of various devices to render riser pipe sections buoyant in order to reduce or eliminate the need for riser tensioners. See, for example, U.S. Pat. Nos. 3,768,842; 3,017,934 and 3,221,817.

SUMMARY OF THE INVENTION

This invention relates to a new and improved marine riser system for offshore oil well structures for making a series of joined riser sections sufficiently buoyant to substantially reduce the need for riser tensioners or other similar apparatus for applying tension to the riser column. The buoyant riser system of the preferred embodiment of this invention is adapted to extend from an offshore drilling platform or vessel to a subsea wellhead for encasing the drill string therein. The buoyant riser system includes one or more riser sections having a cylindrical riser pipe for actually enclosing the drill string. A plurality of elongated, hollow, closed tanks having a gaseous fluid therein are mounted in a circumferential relationship about the cylindrical riser pipe by a mounting means. The mounting means of the preferred embodiment of this invention includes one or more pairs of semi-cylindrical mounting plates having the closed, elongated buoyant tanks mounted therewith, each of the mounting plates having lug end portions which are used to align the mounting plates and receive bolt connectors for mounting the semi-cylindrical mounting plates about the riser pipe.

The riser pipe sections have mounted thereon spaced mounting rings which provide an annular mounting recess therebetween for receiving semi-circular internal edges of aligned pairs of semi-cylindrical mounting plates. An annular gasket is mounted in the mounting recess and has an annular gasket recess therein for receiving the internal, semi-circular mounting plate edges.

DESCRIPTION OF THE PREFERRED EMBODIMENT

Figure 1:
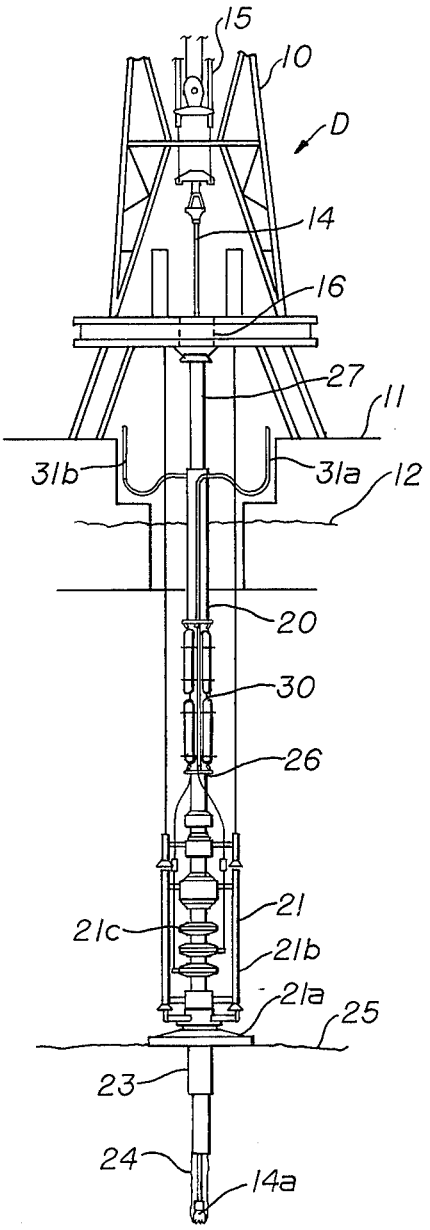
FIG. 1 is a partly schematic view of an offshore oil well drilling operation indicating the relative position and use of the buoyant riser system of the preferred embodiment of this invention.
Figure 2:
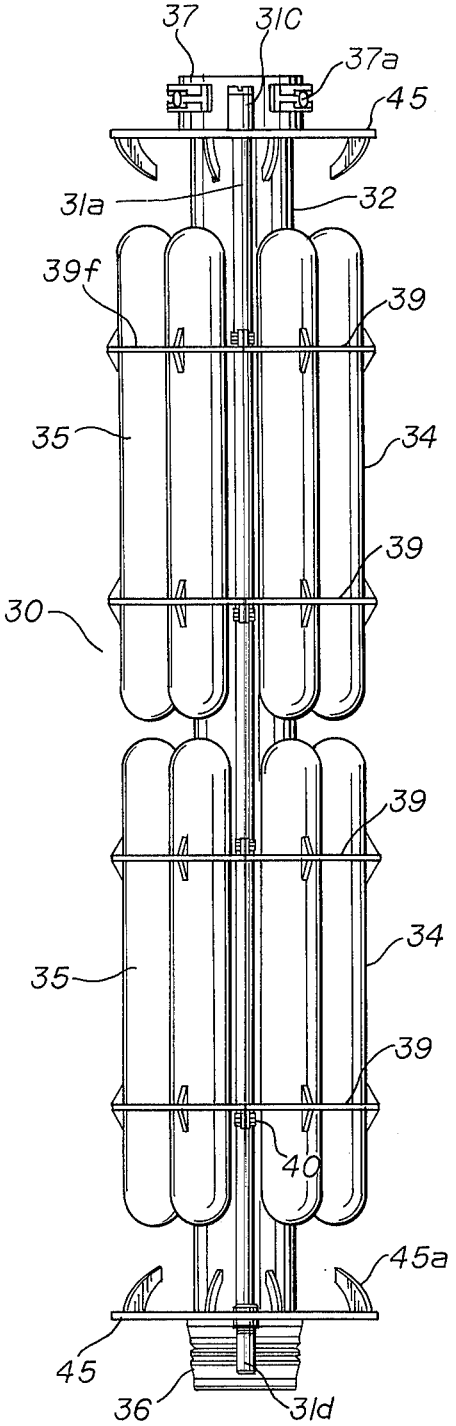
FIG. 2 is a side view of a buoyant riser section of the preferred embodiment of this invention.
Figure 3:
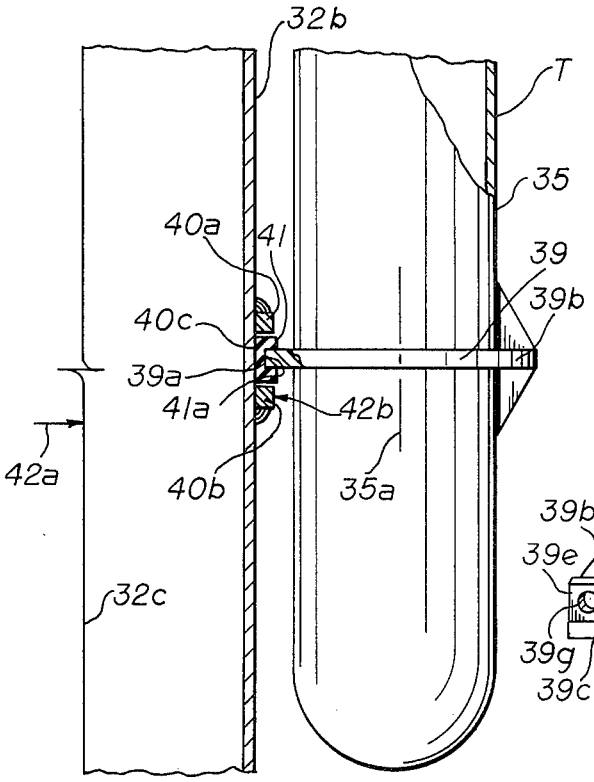
FIG. 3 is a partly sectional view which indicates the mounting means of this invention for mounting buoyant riser tanks.
Figure 4:
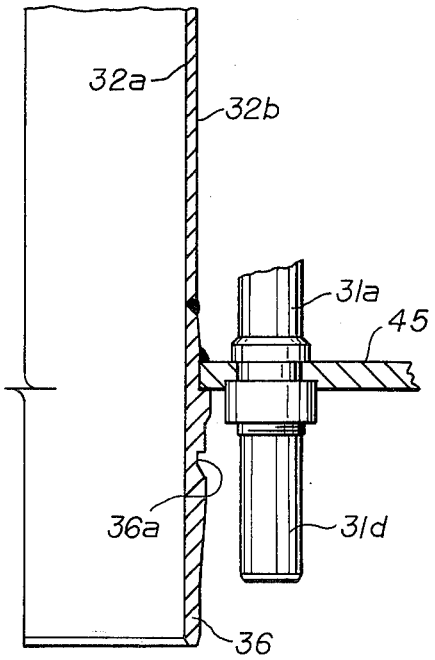
FIG. 4 is a partly sectional view indicating the mounting supports for choke and kill lines.
Figure 5:
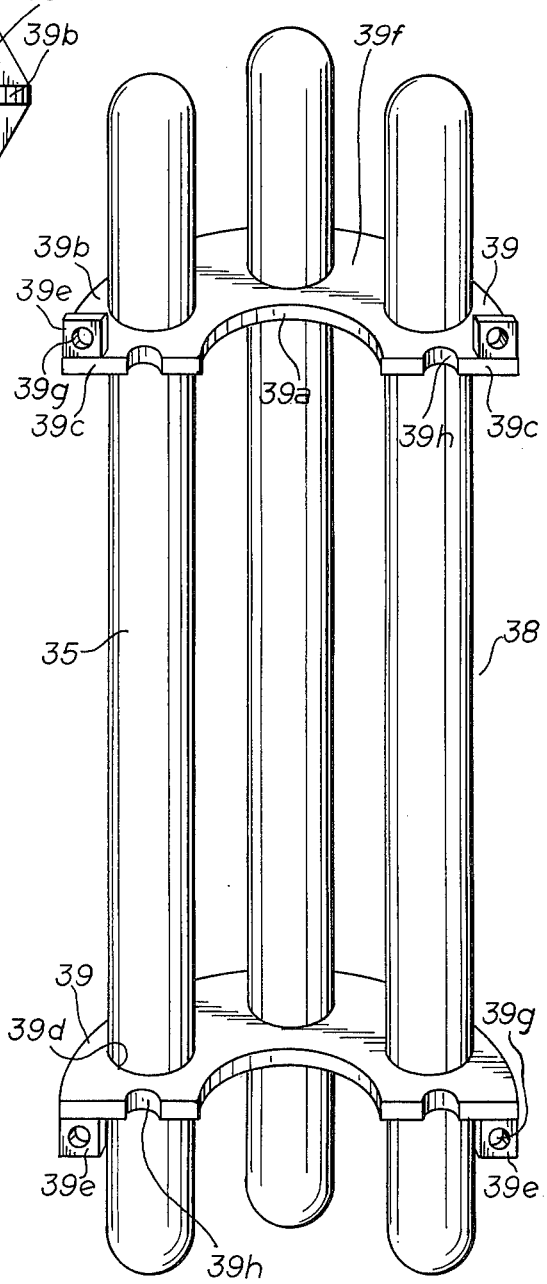
FIG. 5 is an isometric view of the semi-cylindrical mounting plates which support the buoyant tanks.

Referring to the drawings and in particular FIG. 1, an offshore oil well network D is schematically illustrated. A derrick superstructure 10 is supported on a platform 11. The platform 11 may be a floating platform such as a drilling ship or other vessel such as a semi-submersible drilling rig; or, the platform may be supported on suitable leg structures such as is known in the art. In the embodiment illustrated in FIG. 1, the platform 11 is actually floating on the surface 12 of a body of water. The derrick super-structure 10 supports a drill string 14 which is suspended from a motion compensator 15 of a type known in the art. The drill string 14 extends downwardly from the motion compensator through the rotary table illustrated at 16 and downwardly through marine riser system 20 of the preferred embodiment of this invention to a subsea wellhead 21. The subsea wellhead 21 includes a base 21*a* having mounted thereon a suitable guide structure 21*b* and a blowout preventer stack 21*c*. A casing hanger assembly 23 extends downwardly into the wellbore 24 for guiding the drill bit 14*a* mounted at the bottom of the drill string 14 in a known manner. The wellhead base 21*a* is positioned at the ocean floor or mudline 25. The marine riser system 20 extends from the blowout preventer stack 21*c* upwardly to the derrick superstructure below the rotary table 16. The marine riser system 20 includes a suitable flexible joint and adapter 26 which mounts the marine riser system 20 to the top of the blowout preventer stack 21*c*. In addition, a suitable telescopic riser joint generally designated as 27 mounts the marine riser system 20 below the rotary table 16.

The marine riser system 20 of the preferred embodiment of this invention includes one or more buoyant riser sections generally designated at 30 which are illustrated in detail in FIGS. 2–5. Choke and kill lines 31*a* and 31*b* extend from the floating platform 11 downwardly along the marine riser system and into fluid connection with the blowout preventer stack 21*c*.

The buoyant riser section 30 includes a hollow, cylindrical riser pipe 32 having mounted therewith two, longitudinally spaced sets 34 of circumferentially spaced buoyant tanks 35. The riser pipe 32 is hollow for receiving a portion of the drill string 14 and for allowing for the circulation of drilling fluid between the drill string 14 and cylindrical, inside riser pipe wall 32*a*. The riser pipe section 32 may be connected to other buoyant riser sections by means of the male or pin end connector 36 and female or box end connector 37. The male end connector 36 will include one or more annular recesses such as 36*a* adapted to be seated in the box end connector 37 of another riser pipe 32. The box end connector 37 may be of any suitable type adapted to receive and lock in place a male riser pipe end section such as 36. For example, the box end connector 37 in the emmbodiment illustrated in FIG. 2 has a lock ring (not shown) positioned therein; the lock ring is capable of being set radially inwardly into a pin groove such as 36*a* by means of a series of radial screws 37*a*. Such a box-type connection as 37 is illustrated in U.S. Pat. No. 3,647,245.

Each of the longitudinally spaced sets 34 of buoyant riser tanks 35 includes two identical, oppositely positioned groups on assemblies 38 (FIG. 5) of buoyant riser tanks 35. Each buoyant riser tank group 38 includes two, spaced semi-cylindrical, identical mounting plates 39 for housing the tanks 35. Each semi-cylindrical mounting plate 39 includes an interior, semi-circular edge 39*a* and an exterior, semi-circular edge 39*b* which are joined by substantially flat end portions 39*c* which mate against identical end portions on oppositely positioned mounting plates 39 of another group 38. Each of the mounting plates 39 includes three, circumferentially spaced openings 39*d* adapted to receive three buoyant tanks 35. The buoyant tanks 35 are mounted in the circumferentially spaced openings 39*d* of the mounting plates 39 by welding or other suitable means.

Each mounting plate 39 further includes upstanding, lug members 39*e* extending at right angles from flat, annular surface 39*f*, which extends between semi-circular interior and exterior edges 39*a* and 39*b*, respectively. The lug portions 39*e* have bolt openings 39*g* therein. Thus when two buoyant tank groups 38 are oppositely positioned about exterior, cylindrical outside riser pipe surface 32*b*, the lug portions 39*e* on oppositely positioned mounting plates 39 may be aligned such that the bolt openings 39*g* in oppositely positioned, aligned lug portions are also aligned to receive bolt-type connectors 40.

The tanks 35 in each buoyant tank group 30 are elongated, hollow, enclosed metal tanks having therein a gaseous medium such as air at one atmosphere pressure. Longitudinal axis 35*a* of each tank 35 is positioned parallel to longitudinal axis 32*c* of the riser pipe 32.

The pipe riser 32 includes four sets of mounting rings 40*a* and 40*b* which are fixed onto the outside pipe riser surface 32*b* and appropriately spaced to receive the interior mounting edges 39*a* of the semi-cylindrical mounting plates 39. The mounting rings 40*a* and 40*b* in each set are welded or otherwise suitably attached to the cylindrical pipe riser surface 32*b*. The mounting rings 40*a* and 40*b* in each set are spaced apart to form a recess 40*c*. The recess 40*c* has mounted therein an annular gasket 41 to provide protection against galvanic corrosive action between the mounting plates 39 and the riser pipe 32. The annular gasket 41 positioned between the rings 40*a* and 40*b* in each set of mounting rings is made of suitable, known materials to accomplish the corrosion prevention. Each of the annular gaskets 41 has an annular recess 41*a* therein to actually receive the interior, mounting edge 39*a* of each of the semi-cylindrical mounting plates 39. When measured from the pipe riser center line 32*c*, the radial distance between the center line 32*c* and the outside edge of the mounting rings 40*a* and 40*b*, as identified by arrows 42*a* and 42*b*, is greater than the radial distance between the pipe riser center line 32*c* and the gasket recess 39*a*. In this manner, the interior mounting edges 39*a* of each of the mounting plates 39 is secured between the riser mounting rings 40*a* and 40*b* in the annular gasket recesses 41*a*.

Choke and kill lines such as 31*a* in the embodiment of the invention illustrated extended through the semi-cylindrical mounting plates 39 and are seated in choke and kill mounting plates 45. The choke and kill mounting plates 45 are welded or otherwise suitably attached to the outside riser pipe surface 32*b* in order to secure the positions of the choke and kill lines such as 31*a*. The choke and kill lines such as 31*a* terminate in box end connector portions 31*c* and in pin end connector portions 31*d*. The pin end 31*d* of the choke and kill line 31*a* is located at the same end as the pin end 36 of the pipe riser 32. Similarly, the choke and kill line box end 31*c* is located at the box pipe riser end 37. Curved struts 45*a* are welded onto the choke and kill line support plates 45. The semi-cylindrical mounting plates 39 for the buoyant tanks 35 include semi-circular openings 39*h* for receiving the choke or kill lines such as choke line 31*a*. Although the choke and kill lines are described as being part of the embodiment of the invention illustrated and described herein, it should be understood that the choke and kill lines may be independently mounted in a well-known manner, if desired.

It has been discovered that the elongated, cylindrical, enclosed tanks 35 are preferably made of aluminum alloy, which is capable of providing greater collapse resistance while being lighter in weight as compared to a steel tank of the same size. Aluminum tanks 35 are capable of exerting greater buoyant forces in water when compared to steel tanks of the same size and yet the thickness of the aluminum walls can be made greater than the thickness of the steel walls for the purpose of providing greater collapse resistance.

Utilizing thin-walled vessel formulas found in Roark *Formulas for Stress and Strain*, 4th Edition, 1965, the following analysis demonstrates that a stronger lighter-weight tank of aluminum is superior.

Collapse resistance ($C_R$) is directly proportional to the modulus of elasticity (E) times the tank wall thickness cubed ($t^3$).

$$C_R \alpha E t^3$$

The modulus of elasticity for aluminum ($E_{AL}$) is equal to approximately 0.3 times the modulus of elasticity for steel ($E_{ST}$). And the weight of aluminum ($W_{AL}$) is approximately equal to 0.344 times the weight of steel ($W_{ST}$).

Thus, for an aluminum tank of the same weight and size as a comparable steel tank, the following equations are applicable:

$$C_R \alpha E (0.3) \left(\frac{1}{0.344} t\right)^3$$

$$C_R \alpha = 8 Et^3$$

Thus, an aluminum tank 35 will have approximately 8 times the collapse resistance of a comparably sized steel tank. It has been found that aluminum tanks 35 having a wall thickness of 1.5 to 2 times the thickness of a comparably size steel tank will be (1) lighter in weight and yield greater buoyant force and (2) have superior collapse resistance characteristics.

The gaseous medium may be air, nitrogen or another suitable gas at 1 atmosphere (14.7 LB/in$^2$). It is also within the scope of the invention to provide higher pressures in the tanks 35 in order to provide additional support against collapse. The pressure in the tanks 35 may even increase with the depth of use of the marine riser section 30. Further, the number of tanks 35 in each group 38 may vary and even increase with the depth at which the particular riser section will be used.

The foregoing disclosure and description of the invention are illustrative and explanatory thereof, and various changes in the size, shape, and material as well as in the details of the illustrated construction may be made without departing from the spirit of the invention.

I claim:

1. An offshore oil well buoyant riser system adapted to extend from an offshore drilling platform to a subsea wellhead for encasing a drill string, wherein at least one riser section comprises:

a cylindrical riser pipe for enclosing a portion of the drill string;

a plurality of mounting rings mounted on said riser pipe, each of said rings being longitudinally spaced along said riser pipe with respect to another of said rings to form an annular recess on said riser pipe;

an annular gasket positioned in said annular mounting recess on said riser pipe, said gasket preventing galvanic corrosion and including an annular gasket recess therein positioned inwardly with respect to said spaced mounting rings;

a plurality of elongated, hollow, closed tanks having a gaseous fluid therein;

a pair of semi-cylindrical mounting plates having said tanks mounted therein;

choke and kill mounting plates mounted on said riser pipe to secure choke and kill lines about said riser pipe;

semi-circular openings formed in each of said semi-cylindrical mounting plates for receiving choke and kill lines therethrough;

an internal, semicircular mounting edge on each of said semi-cylindrical mounting plates, said internal, semi-circular mounting edges being mounted into said gasket recesses and being supported by said mounting rings;

lug end portions on each of said semi-cylindrical mounting plates for lining said plates and receiving bolt connectors for securing said plates onto said riser pipe;

said pair of semi-cylindrical plates extending circumferentially around said riser pipe for mounting said tanks circumferentially about said riser pipe with said tanks extending parallel to the longitudinal axis of said riser pipe whereby said tanks cooperate to create sufficient buoyant force in the water to substantially contribute to the application of tensile forces on said riser system.

2. The structure set forth in claim 1, including:

said elongated, closed tanks containing said gaseous fluid at approximately one atmosphere pressure therein.

3. The structure set forth in claim 1, including:

said elongated, closed tanks containing said gaseous fluid at more than one atmosphere for providing additional support said tanks against hydrostatic underwater pressures.

4. The structure set forth in claim 1, wherein:

said hollow, closed tanks are aluminum.

5. The structure set forth in claim 4, wherein:

said aluminum tanks have walls of a thickness of approximately twice the thickness of the walls of an equivalent steel tank and weighing less than an equivalent steel tank and having greater collapse resistance.

* * * * *